United States Patent [19]

Michalik et al.

[11] 4,190,243

[45] Feb. 26, 1980

[54] FOLDER ASSEMBLY FOR BOOK FOLDING

[75] Inventors: Horst B. Michalik, Hochberg; Otto T. Weschenfelder, Wurzburg, both of Fed. Rep. of Germany

[73] Assignee: Koenig & Bauer Aktiengesellschaft, Wurzburg, Fed. Rep. of Germany

[21] Appl. No.: 902,637

[22] Filed: May 4, 1978

[30] Foreign Application Priority Data

May 24, 1977 [DE] Fed. Rep. of Germany ..... 2723358

[51] Int. Cl.[2] ..... B65H 45/22

[52] U.S. Cl. ..... 270/66; 270/21; 270/42

[58] Field of Search ..... 270/38, 42, 21, 47–50, 270/6, 7, 10, 11, 13, 14, 19, 70–72, 66, 74–77

[56] References Cited

U.S. PATENT DOCUMENTS

| | | | |
|---|---|---|---|
| 1,258,708 | 3/1918 | Roesen | 270/38 |
| 2,026,443 | 12/1935 | Tomlin | 270/65 |
| 2,138,054 | 11/1938 | Zuckerman | 270/47 |

FOREIGN PATENT DOCUMENTS

| | | | |
|---|---|---|---|
| 1229550 | 6/1967 | Fed. Rep. of Germany | 270/62 |

*Primary Examiner*—Edgar S. Burr
*Assistant Examiner*—A. Heinz
*Attorney, Agent, or Firm*—Jones, Tullar & Cooper

[57] ABSTRACT

A folding assembly for book folding in web-fed rotary printing machines is disclosed. A take-over or transfer cylinder, which is capable of operating in either straight or collect run production, transfers signatures to an acceleration section which is run at a selected speed to deliver the signatures to a longitudinal folding device in a spaced array thereby allowing adequate time for the longitudinal folding device to perform a second longitudinal folding operation on the signatures. The speed of the acceleration section is varied by changing its gear drives.

5 Claims, 4 Drawing Figures

FOLDER ASSEMBLY FOR BOOK FOLDING

FIELD OF THE INVENTION

The present invention is directed generally to a folding assembly for book folding in a web-fed rotary printing machine. More particularly, the present invention is directed to such a folding assembly having means for facilitating a second longitudinal folding of the signatures during either straight or collect run production. Most specifically, the folding assembly in accordance with the present invention includes an accelerating conveyor section positioned between the transfer cylinder and the longitudinal folding device.

The folding assembly in accordance with the present invention includes a cutting knife cylinder, a take-over or transfer cylinder operable in straight or collect run production, a conveyor cylinder, an acceleration section and a longitudinal folder. The acceleration section can be run either at the same speed as, or twice as fast as the peripheral speed of the transfer cylinder so that the signatures from the transfer cylinder are properly spaced in the acceleration section to arrive at the longitudinal folder sufficiently spaced to allow adequate time for folding.

DESCRIPTION OF THE PRIOR ART

Folders for book folding in web-fed rotary printing presses are known generally in the prior art as shown, for example, in German Patent No. 1,229,550. In this prior art, however, there has been required the provision of duplicate longitudinal folding devices when the apparatus was to be run in double or straight run production. The use of two longitudinal folding devices was required since these folders operate in the longitudinal direction of the moving signatures instead of transversely thereto and require a certain period of time to fold a signature. Two such longitudinal folding devices were required in straight run production with the signatures being alternated between the longitudinal folding devices. This necessity of having dual longitudinal folders increased the space required and the cost of operation and equipment.

SUMMARY OF THE INVENTION

It is an object of the present invention to provide a folder assembly for book folding in which only one longitudinal folding device is required.

As will be discussed in greater detail in the description of a preferred embodiment, the folder assembly in accordance with the present invention includes a cutting cylinder, a transfer cylinder capable of operating in either straight or collect run production, an accelerating conveyor section and a longitudinal folding device. The speed of the accelerating conveyor section may be varied with respect to the speed of the transfer cylinder so that signatures delivered to the accelerating section may be suitably spaced for delivery to the longitudinal folding device in a spaced array. The longitudinal folding device can then perform a so-called second longitudinal fold on the signatures without reducing the speed of production of the printing press. The folder assembly in accordance with the present invention requires only one longitudinal folding device and, therefore, requires less space and is less expensive than prior devices.

BRIEF DESCRIPTION OF THE DRAWINGS

While the novel features of the folder assembly for book folding in accordance with the present invention are set forth with particularity in the appended claims, a full and complete understanding of the invention may be had by referring to the following description of a preferred embodiment and as may be seen in the accompanying drawings in which:

DESCRIPTION OF A PREFERRED EMBODIMENT

Figure 1:
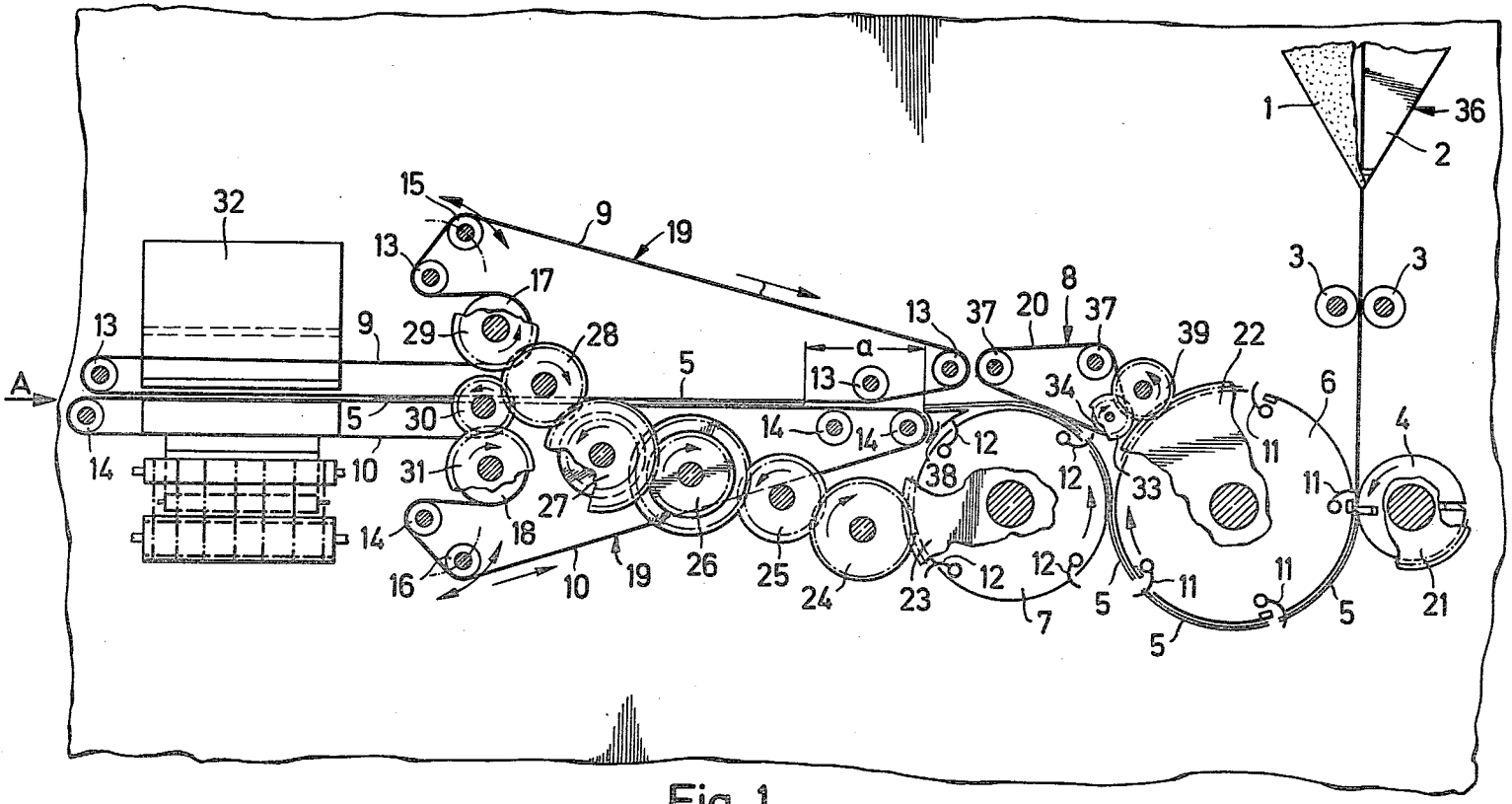
FIG. 1 is a schematic side view of a folder assembly in accordance with the present invention with portions of the side frames being removed for clarity.

Turning now to FIG. 1, there may be seen a preferred embodiment of a folder assembly for book folding in accordance with the present invention. A plurality of paper webs are printed in a conventional manner in conventional printing presses which may, by way of example, be provided with two printing plates around their periphery. The printing presses are not shown in the present disclosure since they are conventional and well known. The printed webs of paper 1 are fed into a folder 36 and are conveyed through a former 2 and into a pair of spaced feed rolls 3. This folder 36 and former 2 is also well known and need not be further described. Alternatively, the longitudinal fold applied to the paper webs 1 by the folder 2 could be arrived at by using a turning bar infeed in which the associated paper webs are longitudinally cut by means of cutting knives and are placed on each other by the turning bars.

The associated paper webs 1, which are longitudinally folded the first time by the former 2, are then fed to a cutting knife cylinder 4 which cooperates with the five counter cut bars of a take-over or transfer cylinder 6 to sever the paper webs 1 into signatures 5. These signatures 5 are held on the peripheral face of the take-over cylinder 6 by use of suitable gripping means such as pins 11. It will be understood that alternate gripping means may alternatively be used.

The take-over or transfer cylinder 6 may either operate in straight or in collect run production. In straight run production, each signature 5 is severed from the web 1 and is merely transferred by take-over cylinder 6. In collect run production each signature is severed from web 1, and is retained on take-over cylinder 6 for more than a full revolution while a second different signature 5 is collected by the take-over cylinder thereby producing a two part signature assembly. In the straight run mode, take-over cylinder 6 merely transfers signatures while in collect run, cylinder 6 collects signatures and then transfers them.

Figure 2:
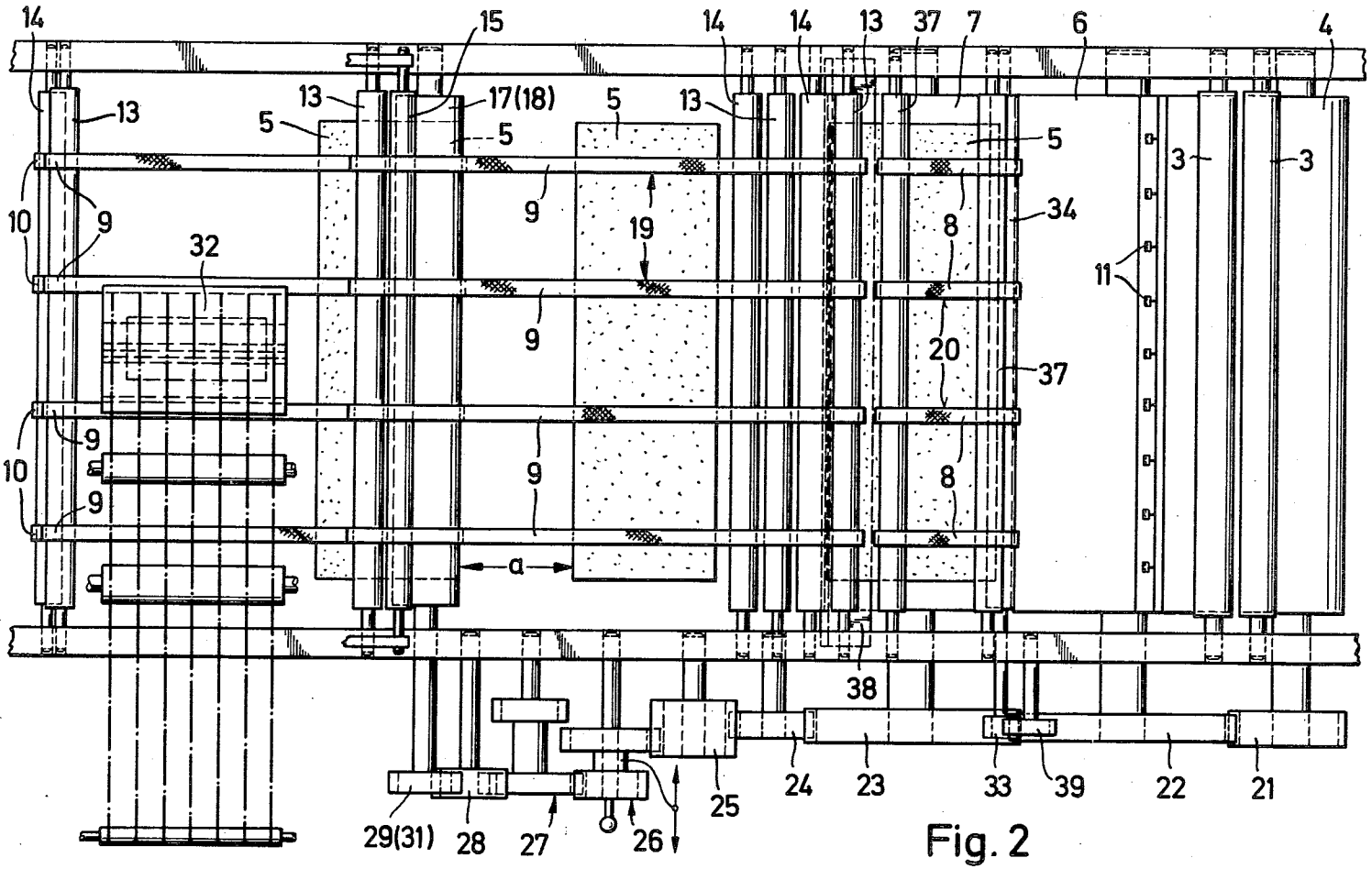
FIG. 2 is a schematic plan view of the folder assembly of FIG. 1.

The signatures 5 are taken from take-over cylinder 6 and are transferred by a conveyor cylinder 7 which is placed adjacent the take-over cylinder 6 and a first signature conveyor system, generally at 8, which is coordinated to the cylinder conveyor 7. The first signature conveyor system 8 is comprised of, for example, four tapes 20 which are arranged side by side and are guided by means of guide rolls 37 that are commonly driven over a tape roll 34. The drive of the tape roll 34 is effected by means of spur gears 33 and 39 as seen in FIGS. 1 and 2. Spur gear 39 meshes with spur gear 22 which is associated with take-over cylinder 6. The tapes 20 rotate at a speed equal to the peripheral speed of the conveyor cylinder 7 and contact the signatures 5. The purpose of the tapes 20, which cooperate with the conveyor cylinder 7, is to convey the signatures 5 to an acceleration section 19.

Acceleration section 19 comprises, in the preferred embodiment, a number of upper tapes 9 and lower tapes 10, which are all driven at an equal peripheral speed. Four upper tapes 9 and four lower tapes 10 are arranged side by side, as may be seen in FIGS. 2 and 3. The upper tapes 9 are guided over guide rolls 13 and their common drive is effected by a scored tape roller 17 through driving spur gear 9. A tape tension device 15 is provided for maintaining the tension of the tapes 9. The lower tapes 10 are guided over guide rolls 14. Maintenance of the tension of the lower tapes 10 is provided by a lower tape tension device 16, and drive of lower tapes 10 is effected by a lower tape roll 18.

Figure 3:
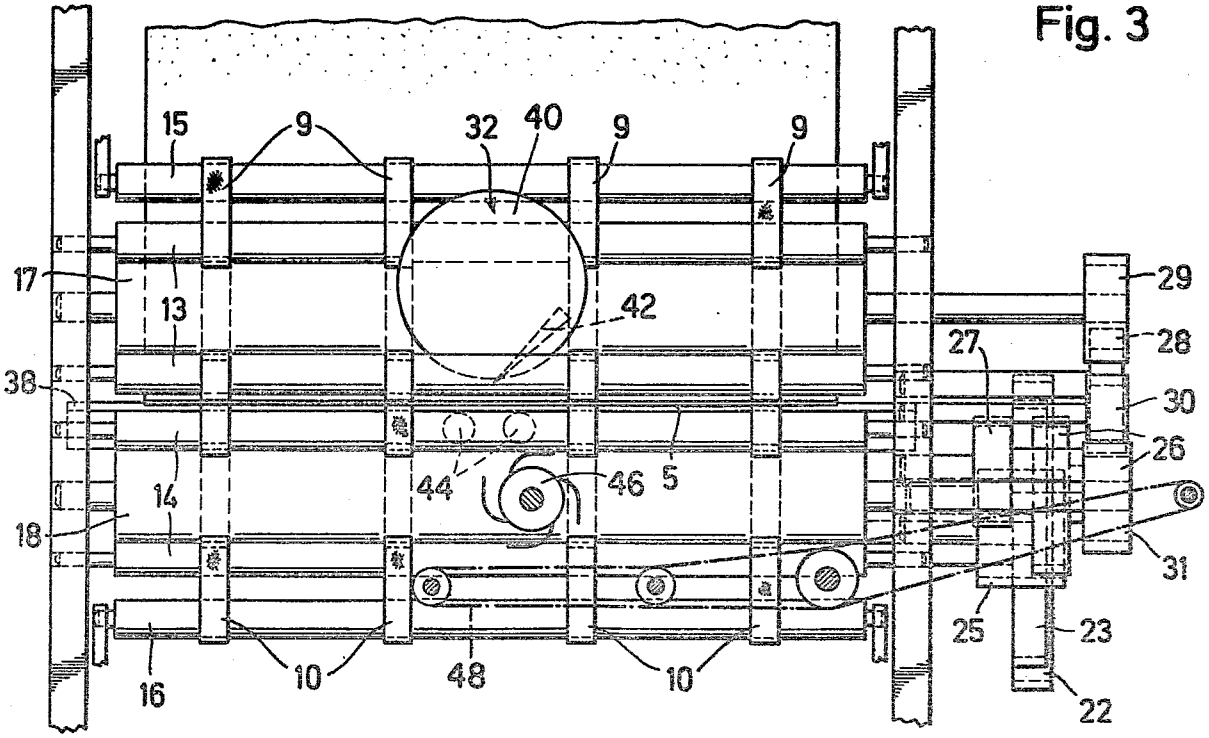
FIG. 3 is a schematic end view of the folder assembly of the present invention taken in the direction indicated by arrow A in FIG. 1.
Figure 4:
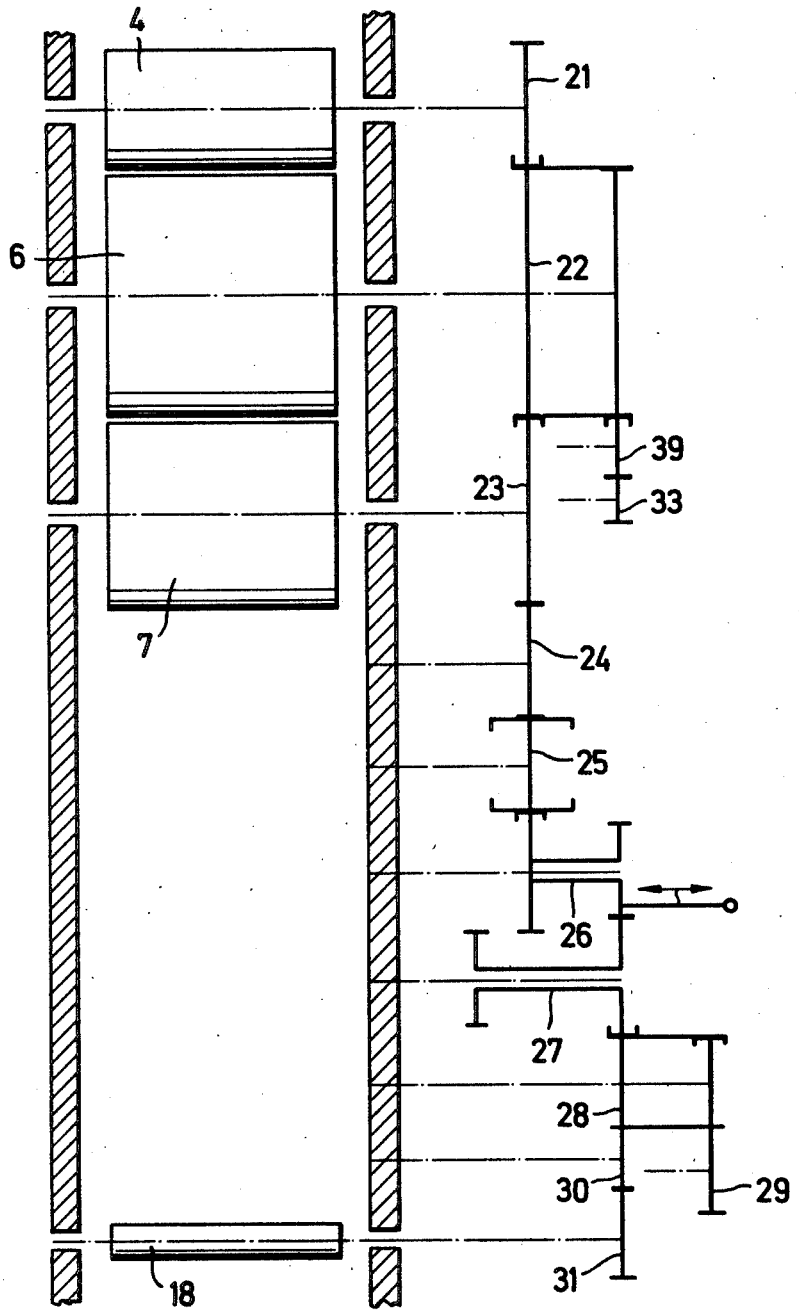
FIG. 4 is a schematic plan view of the folder assembly showing the positioning and cooperation of the drive gears.

The drive of the upper tapes 9 and the lower tapes 10 is effected through spur gear train 21, 22, 23, 24, 25, 26, 27, 28, 29, 30, 31, as seen in FIGS. 1–4 and particularly in FIG. 4. Spur gear 21 is, in the embodiment described, the driving gear for the cutting knife cylinder 4, spur gear 22 is the driving gear for the conveyor cylinder 7, spur gear 31 is the driving gear for the tape roller 18, and spur gear 29 is the driving gear for the upper tape roll 17. In the embodiment described, spur gears 26 and 27 are designed as double gears, with spur gear 26 being a sliding gear. Variation of the rotational speed of the upper tapes 9 and the lower tapes 10 between a rotational speed, which is equal to and one which is double the peripheral speed of the take-over cylinder 6 or the conveyor cylinder 7, is obtained by use of the double spur gears 26 and 27. As may be seen in FIG. 4, sliding of gear 26 will vary the gear ratio to the gears 29 and 31 which drive the upper and lower tape rolls 17 and 18, respectively. As indicated above, by varying the position of the slidable double spur gear 26, the speed of rotation of the upper and lower tapes 9 and 10 of the acceleration section 19 can be either made equal to the peripheral speeds of the take-over and conveyor cylinders 6 and 7 or can be made to be twice their speed.

The upper and lower tapes 9 and 10 are guided through a conventional longitudinal folding device generally at 32 which may be seen most clearly in FIGS. 2 and 3. This longitudinal folder is driven synchronously with the acceleration section 19 in a conventional manner. As may be seen most clearly in FIG. 3, the longitudinal folding device 32 includes a rotating cylinder 40 equipped with a folding blade 42 which extends outwardly from cylinder 40 to contact a signature 5 therebeneath and force signature 5 into the space between a pair of folding rollers 44. These folding rollers pull the signature downwardly into engagement with a rotating delivery fan 46 which deposits the folded signatures 5 onto a folded signature conveyor 48. This longitudinal folder 32 is well known and in the present embodiment is utilized to perform the so-called second longitudinal folding operation of the signatures.

In operation, signatures 5 cut by the cutting knife cylinder 4 cooperating with the counter cut bar of the take-over cylinder 6 are taken over by the pins or similar grippers 11 of the take-over cylinder 6, and are transferred to the pin or similar gripper system 12 of the conveyor cylinder 7. In the preferred embodiment, the take-over cylinder 6 is designed as a 5/2 collecting cylinder, and the conveyor cylinder 7 is designed as a 4/2 cylinder. The take-over cylinder 6 is capable of being switched over in a known manner from a collect run production mode to a double or straight run production mode. It would also be possible for take-over cylinder 6 to operate only as a transporting cylinder, so that collecting of signatures would not be possible. The first signature conveyor system 8 presses the signatures 5, which have been released from the pins or grippers 12 of the conveyor cylinder 7, onto the periphery of the conveyor cylinder 7 and conveys the signatures 5 over separators 38 and to the acceleration section 19 by means of the endless tapes 20, which rotate at a speed equal to the peripheral speed of the conveyor cylinder 7. The tapes 20 transport the signatures 5 with a speed equal to the peripheral speed of the conveyor cylinder 7 into the nipping point between the upper tapes 9 and the lower tapes 10, where each signature is taken over by the acceleration section 19 and is accelerated to the speed of the conveyor tapes 9, 10. The upper tapes 9 and the lower tapes 10 of the acceleration section 19 are caused to rotate, if the take-over cylinder 6 is switched to straight production, at a speed which is twice the peripheral speed of the cylinders 6 and 7. This provides the essential feature of the invention, that is with double or straight production, a space "a" is artifically created between signatures 5 as they pass through the acceleration section 19. As is well known, the prior folders produced a stream of signatures in double or straight production in which there was no such space "a" between the signatures 5. In a sequence of adjacent signatures of this kind, the so-called second longitudinal folding operation would not be possible since the longitudinal folding operation is not effected transversely to the moving direction of the signatures 5, but in their longitudinal direction and requires a certain period of time for one signature to clear the longitudinal folder 35 before the next signature can be folded.

If the take-over cylinder 6 is switched over and run in collect production so that each of its collecting fields releases a collected signature to the conveyor cylinder 7 only once every two revolutions, then these collected signatures are delivered to the acceleration conveyor section already in the spaced array so that the speed of the tapes 9 and 10 on the accelerating section 19 should rotate with a peripheral speed equal to that of the peripheral speeds of cylinders 6 and 7. This is accomplished by shifting the slidable, double spur gear 26.

It will thus be seen that the folder assembly for book folding in accordance with the present invention provides an assembly where only one longitudinal folder 32 need be utilized instead of the two such folders required in this assembly in the past. The provision of the acceleration section 19 allows the signatures to be spaced one from the other in straight or double production once they have left the take-over and conveyor cylinders. This spacing of the signatures allows sufficient time for each one to be handled in turn by the longitudinal folding device. Since the speed of the tapes in the acceleration cnoveyor section can be switched between twice the speed of the take-over and conveyor cylinders and the same speed as these cylinders, the take-over cylinder can accordingly be used in both double or straight run production and collect run production.

While a full and complete description of a preferred embodiment of a folder assembly for book folding in accordance with the present invention has been set forth fully and completely hereinabove, it will be obvious to one of ordinary skill in the art that a number of changes in, for example, the take-over and conveyor cylinders, the number of tapes required, the type of gear train provided and the like could be made without departing from the true spirit and scope of the invention, and accordingly the invention is to be limited only by the following claims.

We claim:

1. A folder assembly for book folding in a web-fed rotary printing machine, said folding assembly folding signatures which have been severed from associated printed webs, said folder assembly comprising:

a rotatable cuttng knife cylinder and a rotatable take-over cylinder, said cutting knife cylinder severing the webs into a series of signatures;

means for selectively operating said take-over cylinder in either a straight run production mode or a collect run production mode;

a totatable conveyor cylinder and a first signature conveyor system, said conveyor cylinder and said first signature conveyor system cooperating to receive the signatures from said take-over cylinder;

a signature acceleration section for receiving the signatures from said conveyor cylinder and said first signature conveyor system and operating to regulate the spacing between signatures;

a longitudinal folding device for receiving the signatures from said signature acceleration section and for longitudinally folding the signatures; and means for operating said signature acceleration section at a first speed when said take-over cylinder is in the straight run production mode and at a second, different speed when said take-over cylinder is in the collect run production mode whereby said signature acceleration section delivers the signatures to said longitudinal folding device in a spaced array.

2. The folder assembly of claim 1 wherein said signature acceleration section operates at a speed twice the peripheral speed of said take-over cylinder when said take-over cylinder operates in the straight run production mode.

3. The folder assembly of claim 1 wherein said signature acceleration section operates at a speed equal to the peripheral speed of said take-over cylinder when said take-over cylinder operates in the collect run production mode.

4. The folder assembly of claim 1 wherein said means for operating said signature acceleration section at said first or second speed is a slidable double spur gear.

5. A method of book folding signatures in a folding assembly in a web-fed rotary printing press said method comprising:

generating a series of moving signatures by severing said signatures from an associated web using a rotatable cutting knife cylinder and cooperating take-over cylinder, said take-over cylinder being selectively operable in either a straight run production mode or a collect run production mode;

transferring said signatures to a rotatable conveyor cylinder and cooperating first signature conveyor system, said conveyor cylinder and said first signature conveyor system forwarding said signatures to a signature acceleration section; and conveying the signatures with said accelerating section at two different speeds by controlling the speed of operation of said signature acceleration section to operate said signature acceleration section at a first speed when said take-over cylinder is in the straight run production mode and at a second, different speed when said take-over cylinder is in the collect run production mode to transfer the signatures in a spaced array from said conveyor cylinder and said first signature conveyor system to a longitudinal folding device whereby the signatures are delivered to the longitudinal folding device with sufficient space between succeeding ones of the signatures to provide sufficient time for each signature to be folded by the longitudinal folding device.

* * * * *